US006327727B1

(12) United States Patent
Bocharnikov

(10) Patent No.: US 6,327,727 B1
(45) Date of Patent: Dec. 11, 2001

(54) PHEUMATIC CRADLE

(76) Inventor: Viktor Bocharnikov, P.O. Box 270, 2101 Crystal Plz. Arcade, Arlington, VA (US) 22202

( * ) Notice: Subject to any disclaimer, the term of this patent is extended or adjusted under 35 U.S.C. 154(b) by 0 days.

(21) Appl. No.: 09/391,487

(22) Filed: Sep. 8, 1999

Related U.S. Application Data

(60) Provisional application No. 60/099,345, filed on Sep. 8, 1998.

(51) Int. Cl.[7] ..... A47C 27/08; A61H 9/00

(52) U.S. Cl. ..... 5/713; 5/706

(58) Field of Search ..... 5/713, 710, 706, 5/655.3, 654, 653

(56) References Cited

U.S. PATENT DOCUMENTS

| | | | | |
|---|---|---|---|---|
| 1,772,310 | * | 8/1930 | Hart | 5/713 |
| 2,998,817 | * | 9/1961 | Armstrong | 5/713 X |
| 3,462,778 | * | 8/1969 | Whitney | 5/713 |
| 3,674,019 | * | 7/1972 | Grant | 5/713 X |
| 4,042,988 | * | 8/1977 | Holliday | 5/706 X |
| 4,225,989 | * | 10/1980 | Corbett et al. | 5/713 |
| 4,267,611 | * | 5/1981 | Agulnick | 5/713 |
| 4,750,224 | * | 6/1988 | Stacke | 5/710 X |
| 4,852,195 | * | 8/1989 | Schulman | 5/710 X |
| 5,103,518 | * | 4/1992 | Gilroy et al. | 5/713 |
| 5,105,488 | * | 4/1992 | Hutchinson et all. | 5/710 |
| 5,117,518 | * | 6/1992 | Schild | 5/713 |
| 5,243,721 | * | 9/1993 | Teasdale | 5/713 X |
| 5,584,085 | * | 12/1996 | Banko | 5/713 X |
| 5,685,036 | * | 11/1997 | Kopfstein et al. | 5/713 |
| 5,687,438 | * | 11/1997 | Biggie et al. | 5/654 |
| 5,701,622 | * | 12/1997 | Biggie et al. | 5/713 |
| 5,783,137 | * | 2/1999 | Yavets-Chen | 5/713 |
| 5,853,005 | * | 12/1998 | Scanlon | 5/83.1 X |
| 5,918,336 | * | 7/1999 | Lee et al. | 5/713 |
| 5,920,934 | * | 7/1999 | Hannagan et al. | 5/713 |
| 6,014,784 | * | 1/2000 | Taylor et al. | 5/713 |
| 6,058,538 | * | 5/2000 | Chapman et al. | 5/713 |
| 6,216,299 | * | 4/2000 | Kahlman | 5/654 |
| 6,216,300 | * | 4/2001 | Hannagan | 5/713 |

* cited by examiner

*Primary Examiner*—Anthony Knight
*Assistant Examiner*—Robert G. Santos
(74) *Attorney, Agent, or Firm*—Rodger H. Flagg

(57) ABSTRACT

A therapeutic treatment apparatus includes an air mattress overlaying a support structure. A remote control unit includes a switch and a timer, which in turn controls an air pump for the cyclic inflation and deflation of the air mattress. The remote control unit may be operated either automatically or manually. The air mattress is periodically inflated and deflated so that a person resting on the air mattress is raised and lowered at selected intervals to experience several passive movements, which induce deep relaxation and other parasympathetic responses. A special support member may be placed between the air mattress and the support structure to provide a desired pressure on a person's spinal joints. A biofeedback device may be used to provide feedback to an operator, or to the remote control unit, to optimize the inflation, dwell and deflation cycles.

16 Claims, 3 Drawing Sheets

PHEUMATIC CRADLE

This application claims benefit of provisional application No. 60/099,345 filed Sep. 8, 1998.

FIELD OF THE INVENTION

The present invention relates to a therapeutic device for deep relaxation and restoration of human body homeostasis.

BACKGROUND OF THE INVENTION

The concept of therapeutic treatment with various devices is well known, and designed to provide static support for a human body and/or specific parts of the human body. Existing therapeutic devices use different physical principals. Some of them include mattresses adapted to provide proper alignment for joints of the spine, firm support devices for the whole back or neck or lower back, devices which use gravity or other forces for stretching, and medical equipment designed for specific positioning, etc. There are also devices having dynamic qualities designed for massage, including devices which have a monotonic rocking motion or vibration, which are designed to induce sleep-like cradles. Air mattresses are also known to support a sleeper thereon.

The present invention is related to devices with dynamic qualities and utilizes cyclic inflation and deflation of an air mattress to produce three dimensional motion to stimulate proprioceptors for inducing deep relaxation and restoring homeostasis, in a manner not previously known in the art.

THEORY

1. Nervous System and Stress

The following discussion is based on the book "Principals of Anatomy and Physiology" by Tortora and Grabowski.

The human being nervous system is structurally divided into two branches: Central nervous system (CNS) and Peripheral nervous system (PNS). CNS consists of the brain and spinal cord. The peripheral nervous system is in turn subdivided into Somatic nervous system (SNS) and Autonomic nervous system (ANS).

The SNS consists of sensory neurons that convey information from cutaneous and special sense receptors primarily in the head, body wall, and extremities to the CNS and motor neurons from the CNS that conduct impulses to skeletal muscles only.

The ANS consists of sensory neurons that convey information from receptors primarily in the viscera to the CNS and motor neurons from the CNS that conduct impulses to smooth muscle, cardiac muscle, and glands.

The motor portion of the ANS consists of two branches: Sympathetic nervous system and Parasympathetic nervous system. With few exceptions the viscera receive instructions from both. Usually, these two divisions have opposing actions. Process promoted by sympathetic neurons often involve expenditure of energy while those promoted by parasympathetic neurons restore and conserve body energy.

Homeostasis is a condition in which the body's internal environment remains within certain physiological limits. Homeostatic mechanisms attempt to counteract the everyday stresses of living. A stressor activates sympathetic nervous system responses such as:

The heart rate and the strength of contraction increase to circulate substances in the blood very quickly to the areas where they are needed to combat the stress.

Blood vessels supplying the skin and viscera (except the heart and lungs) constrict, while blood vessels supplying the skeletal muscles and brain dilate. This routes more blood to organs active in the stress responses while decreasing blood supply to organs that do not play an immediate active role.

The spleen contracts and discharges stored blood, which increases the volume of blood in the general circulation. Red blood cell production accelerates, and the ability of blood to clot increases.

The liver transforms large amounts of stored glycogen into glucose and releases it into the bloodstream. The glucose is broken down by cells to provide the energy needed to meet the stressor. This also raises body temperature and causes sweating.

The rate of breathing increases, and the respiratory passageways widen. This enables the body to acquire more oxygen, which is needed in the decomposition reactions of catabolism. It also allows the body to eliminate more carbon dioxide, which is produced during catabolism.

Production of saliva, stomach enzymes, and intestinal enzymes decrease since digestive activity is not essential for counteracting the stress.

Sympathetic impulses to adrenal medulla increase its secretion of epinephrine and norepinephrine. These hormones supplement and prolong many fight-flight responses. At the next stage in the stress response hypothalamic hormones will initiate a long-term reaction.

All these responses are designed for survival actions. But in modern life in many cases we are not allowed to turn to releasing actions, and thus we cannot disperse energy accumulated in the body by these responses. Day by day we train our sympathetic nervous systems to respond to negative thoughts and emotions. As for parasympathetic ones, they are left for an automatic function, relying on our natural resources.

One of the results of stress in action is higher muscle tone, or the small degree of the muscle contraction present while the muscle is at rest.

2. Proprioceptive Sensations

The following discussion is based on the book "Principals of Anatomy and Physiology", Tortora, Grabowsky.

An awareness of activities of muscles, tendons, and joints and balance or equilibrium is provided by the proprioceptive (proprio=one's own) or kinesthetic (=motion) sense. It informs us of the degree to which muscles are contracted, the amount of tension created in the tendons, the change of position of a joint, and the orientation of the head relative to the ground and in response to the movements. Proprioception enables us to recognize the location and rate of movements of one body part in relation to others. It also allows us to estimate the weight of objects and determine the muscular work necessary to perform a task and to judge the position and movements of our limbs, without using our eyes.

Impulses for conscious proprioception pass along ascending tracts in the spinal cord, to the thalamus and from there to the cerebral cortex. The sensation is perceived in the somatosensory area in the parietal lobe of the cerebral cortex posterior to the central sulcus. At the sme time, proprioceptive impulses also pass to the cerebellum along the sinocerebellar tracts.

Proprioceptors include muscle spindles, tendon organs, and joint kinesthetic receptors. They are located within skeletal muscles, tendons, and joint capsules.

Muscle Spindles

Muscle spindles are specialized groupings of muscle fibers interspersed among regular sketetal muscle fibers and oriented parallel to them. A muscle spindle consists of 3 to 10 specialized muscle fibers called intrafusal muscle fibers that are partially enclosed in a spindle-shaped connective tissue capsule. The central part of an intrafusal fiber does not have the ability to contract, while the ends of this fiber does have the ability to contract through a motor neuron attached to the ends of the intrafusal fiber. The brain can regulate the length of the middle part of the intrafusal fiber by setting a level of sensitivity of the sensory neuron attached to it. This sets the tone of the muscle through the stretch reflex arc.

The stretch reflex results in the contraction of a muscle when it is stretched. Slight stretching of a muscle stimulates receptors in the muscle spindles. In response to the stretch, a muscle spindle produces one or more nerve impulses that propagates along a somatic sensory neuron through the posterior root of the spinal nerve into the spinal cord. The sensory neuron makes an excitatory synapse with a motor neuron in the anterior gray horn. If the excitation is strong enough, an impulse arises in the motor neuron and is conducted along its axon, which projects from the spinal cord into the anterior root. The axon terminals of the motor neuron form neuromuscular junctions with typical skeletal fuscle fibers of the same muscle that contains the activated muscle spindle. Once the nerve impulse reaches the stretched muscle, a muscle action potential is generated, and the muscle contracts. Thus muscle stretch is followed by contraction, which shortens the muscle that had been stretched.

Tendon Organs

Tendon organs (Golgi tendon organs) are proprioceptors found at the junction of a tendon with a muscle. They help protect tendons and their associated muscles from damage due to excessive tension. They also function as contraction receptors; that is, they monitor the force of contraction of each muscle. Each tendon organ consists of a thin capsule of connective tissue that encloses a few collagen fibers. Penetrating the capsule are one or more sensory (afferent) fibers whose dendrites entwine among and around the collagen fibers. When an increase in tension is applied to a tendon, the tendon organ is stimulated (depolarized to threshold). Nerve impulses are generated and these propagate into the spinal cord along a sensory neuron. Within the spinal cord, the sensory neuron synapses with an inhibitory association neuron, which then synapses with and inhibits (hyperpolarizes) a motor neuron that innervates the muscle associated with the tendon organ. Thus, as tension on the tendon organ increases, the frequency of inhibitory impulses increases, and the inhibition of the motor neurons to the muscle developing excess tension causes relaxation of the muscle.

Joint Kinesthetic Receptors

There are several types of joint kinesthetic receptors within and around the articular capsules of synovial joints. Encapsulated receptors are present in the capsules of joints and respond to pressure. Small lamellated corpuscles in the connective tissue outside articular capsules are receptors that respond to acceleration and deceleration of joint movement. Articular ligaments contain receptors similar to tendon organs that adjust reflex inhibition of the adjacent muscles when excessive strain is placed on the joint.

3. Proprioceptive Facilitation

Proprioceptive facilitation is a therapeutic technique designed to diminish muscle tone in relaxed muscles. This technique uses an isometric muscle contraction or contraction of a muscle when the muscle does not or cannot shorten. As a result of application of this technique the muscles become longer in its relation state, thus range of joint movements will be increased and a person will feel relaxed.

The same effect may be reached by systematically positioning the body into specific poses, which puts particular muscles in a light stretch. In this case, a stretch reflex will cause the muscles to contract, but the pose will not allow their movement. An isometric contraction will take place and after the pose is abandoned a new muscle length will be present for some time. Applied systematically a permanent result can be reached. An example of this technique is Yoga.

4. Craniosacral System and Autonomic Nervous System

The following discussion is based on the book "Craniosacral Therapy", Upledger & Vredevoogd.

The brain and spinal cord are nourished by cerebrospinal fluid. It provides an optimal chemical environment for accurate neuronal signaling. It is also a medium for exchange of nutrients and waste products between the blood and nervous tissue. Cerebrospinal fluid is produced by choroid plexuses within the Ventricular system of the brain.

The craniosacral system has the following anatomical parts: the meningeal membranes, the osseous structures to which the meningeal structures attach, the other non-osseous connective tissue structures which are intimately related to meningeal membranes, the cerebrospinal fluid, all structures related to production, resorption and containment of the cerebrospinal fluid.

The craniosacral system is intimately related to, influences, and is influenced by: the nervous system, the musculoskeletal system, the vascular system, the lymphatic system, and endocrine system, and the respiratory system.

The craniosacral system has a rhythmic activity with a normal rate between 6 and 12 cycles per minute. Under reasonably normal circumstances this rhythmic activity appears at the sacrum as a gentle rocking motion which correlates to a broadening and narrowing of the transverse dimension of the head. As the head widens, the sacral apex moves in an anterior direction. This phase of motion is referred to as FLEXION of the craniosacral system. The counterpart of flexion is EXTENSION. During the extension phase, the head narrows in its transverse dimension. The sacral base moves anteriorly while the sacral apex moves posteriorly.

During the flexion phase the whole body externally rotates and broadens, and during extension it internally rotates and narrows slightly.

In a case of a restriction (an impairment to normal physiological motion within the body) craniosacral therapy uses direct and indirect approaches. In direct techniques a therapist gently assists the restricted structure to pass through the resistance barrier. In indirect techniques the therapist follows the restricted structure to its limit in the direction opposite to the resistance barrier. When the structure attempts to return from its extreme position, the therapist becomes immovable.

A beneficial effect of craniosacral therapy is the restoration of flexibility of the autonomic nervous system. Because the autonomic nervous system plays a large role in the homeostatic activity of the body, when autonomic flexibility is restored many homeostatic mechanisms are made more effective.

5. Light Stimuli and Parasympathetic Responses

When a person's mind concentrates on a light monatomic stimulus it has a tendency to go to an altered state of consciousness (hypnosis, meditation, relaxation, touch). In that case fanction of the parasympathetic nervous system prevails over the sympathetic nervous system.

The same effect can be reached if the mind tries to concentrate on sensing very slow passive joint movements and/or very light stretch introduced to the spinal joints.

6. Induction of Parasympathetic Responses

As follows from the previous discussion an induction of parasympathetic responses, such as deep relaxation, and restoration of homeostasis in a human being's body, may be reached by the following stimulation:

1) An introduction of a light stretch to the spinal joints to involve stretch reflex and muscle spindles for proprioceptive facilitation of the paravertebral muscles.
2) An introduction of a light monatomic movement to the spinal joints, to bring about an altered state of consciousness.
3) An introduction of a light motions in the direction of flexion and extension of the craniosacral system.

SUMMARY OF THE INVENTION

From the foregoing, it is seen that it is a problem to provide a device which can actively induce parasympathetic responses by the above mentioned stimulations. The present invention utilizes the dynamics of an air mattress, particularly the slow inflation and deflation made possible by controlling the flow of inlet and outlet air to and from the air mattress.

Specifically, these dynamics provide the following motions:

a) stretching the body along its length as well as its width,
b) moving the body up and down, and
c) bending the body upward and downward along its length as well as its width.

Stretching occurs when the air mattress is fully inflated and an increase in the air pressure starts stretching the material from which the air mattress is made. Traction between the human body and this material will result in stretching the body. That will engage the stretch reflex and muscle spindles and result in induction of parasympathetic responses.

Moving the body up and down as well as stretching and bending upward during inflation and bending backward during deflation are stimuli which will bring about an altered state of consciousness, thus induction of parasympathetic responses will take place.

Bending the body upward and downward during inflation and deflation will facilitate craniosacral motions thus inducing parasympathetic responses.

The therapeutic treatment apparatus includes an air mattress supported upon a suitable structure, a cyclic control timer, a switch for selectively cycling the control timer, and an air pump for supplying air to the air mattress. In use, the air mattress is cyclically inflated and deflated so that a person resting on the air mattress is systematically raised and lowered at selected intervals.

These and other objects according to the present invention are accomplished by provision of an therapeutic treatment apparatus using an air mattress with time controlled, cyclic inflation and deflation of the air mattress.

Other objects and advantages of the present invention will be more readily apparent from the following detailed description when read in conjunction with the accompanying drawings.

DETAILED DESCRIPTION OF THE INVENTION

Figure 1:
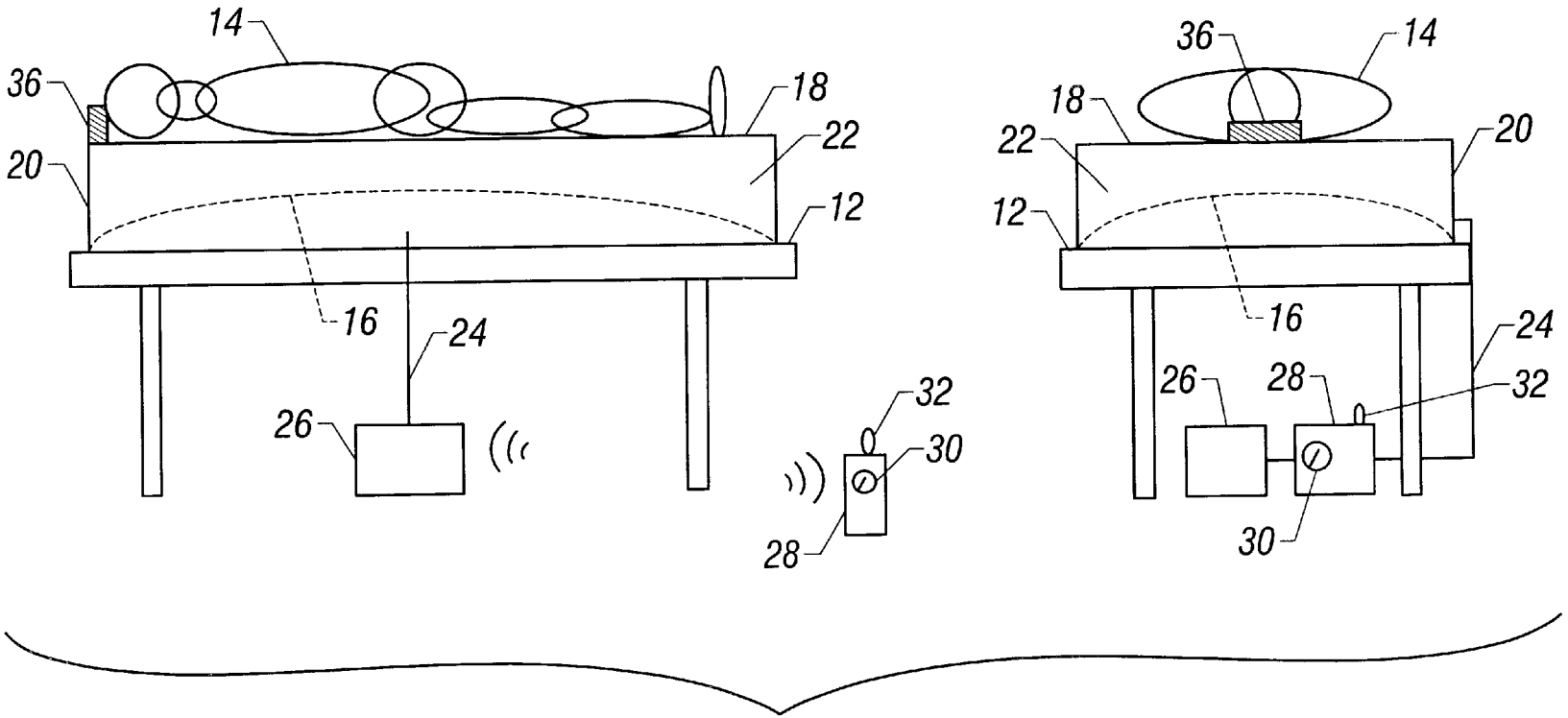
FIG. 1 is a schematic view of the therapeutic treatment apparatus according to the present invention, showing a side and end view at full inflation.

A fully inflated therapeutic treatment apparatus 10 is shown in schematic side and end views in FIG. 1. The therapeutic treatment apparatus 10 is preferably supported upon a suitable support structure 12, such as a table, bed, floor, or therapeutic device sized to support a person 14 in a supine position thereon.

Preferably, the height of the air mattress 20 should be between four and twelve inches when fully inflated, to provide physiologically normal flexion of the person's body when the air mattress 20 is half deflated (maximum flexion).

The construction of the air mattress 20 may include internal elements 22 which provide for extension of the person's 14 body when the air mattress 20 is fully inflated.

The air mattress 20 is preferably inflated to a maximum pressure of three to twelve pounds per square inch (p.s.i.) to suit the desired firmness of the air mattress 20.

A special support member 16 having a pre-selected curvature can be positioned beneath the air mattress 20 on the support structure 12 in approximate alignment with the person's 14 spine to provide physiologically normal flexion and/or extension of the person's 14 body, and may also provide specific pressure on the person's 14 vertebral column. When inflated, the air mattress 20 covers or hides the underlying special support member 16, and the person 14 does not experience pressure directly from the special support when the air mattress 20 is inflated.

As shown in FIG. 1, a suitable air pump 26 is connected through a suitable air supply line 24 to the air mattress 20. A remote control unit 28 is provided to control the cyclic speed of inflation and deflation of the air mattress 20, and to control a dwell time between inflation and deflation cycles. Preferably, the remote control unit 28 is adapted to provide both manual and automatic inflation and deflation of the air mattress 20. The remote control unit 28 is further adapted to be programmed by an operator (not shown).

A biofeedback device 36 may be used to register the level of parasympathetic responses (a level of relaxation).

In operation, the air mattress 20 is initially in an inflated condition, and a person 14 lays on the air mattress 20 in a face-up position. Then the timer 30 is set to control the remote control unit 28 to control cyclic inflation and deflation of the air mattress 20 within defined parameters.

The therapeutic treatment may be characterized by the following parameters:

1) Amplitude of inflation and deflation,
2) Speed of inflation and deflation (i.e., cycles per minute),
3) Number of cycles of inflation/deflation,
4) Dwell time (or no movement) between cycles or within a cycle,
5) Starting position (any position between fully inflated and fully deflated air mattress 20 at the beginning of the treatment).
6) Finishing position (any position between fully inflated and fully deflated air mattress 20 at the end of the treatment).
7) Radius of curvature in body's flexion (it is not flexion of the craniosacral system).
8) Radius of curvature in body's extension (it is not extension of the craniosacral system).
9) Size of the stretch.

Looking at amplitude, the therapeutic treatment apparatus 10 disclosed herein will induce parasympathetic responses in any case and the amplitude of inflation may be different from the amplitude of deflation during the therapeutic session, which depends on individual responses. At the same time full deflation and full inflation will help to excise stretching and fully engage craniosacral motion. See FIG. 2 through FIG. 9. A therapeutic procedure may include the same amplitude of inflation and deflation through all cycles, or it may have evenly changing amplitude in each cycle, so it may start with a maximum value at the beginning of the treatment and zero at the end, and vice a versa.

The speed of inflation and deflation is controlled by the remote control unit 28, to induce parasympathetic responses even if it is different with regard to inflation and deflation. From the point of engaging craniosacral motion the speed should be equal during inflation and deflation and coincide with it. For normal human beings having a craniasacral motion of 6 to 12 cycles per minute, each cycle of inflation and deflation of the air mattress 20 should be more than one minute in duration. At the same time, the speed of any movements translated to a person's 14 body should not be less than a speed which can be sensed by the person 14 who receives the treatment. This may very from person 14 to person 14. Obviously, the less the threshold of sensitivity (an ability to sense the slowest speed), the more a person 14 is relaxed.

The number of cycles may very from person 14 to person 14. A person 14 may find it very relaxing to sleep all night on such a dynamic air mattress 20. From the point of inducing parasympathetic responses, the number of cycles may be limited by the time when a person's 14 parasympathetic responses become stable. This stage may be registered by a biofeedback device 36, which will send a command to the remote control unit 28 to come to a finishing position.

Dwelling time, or the time of rest between cycles or within cycles, can be set by a timer 30, and used as a variable feature of the invention. This feature is necessary when the special support member 16 is used.

Starting or finishing position is preferably at a level of inflation of the air mattress 20 in the static stage. When determining the starting or finishing position, several things should be taken into consideration. For example, it is more safe for a person 14 to lay down on the fully inflated or fully deflated air mattress 20. If it is anticipated that a person 14 will sleep on the air mattress 20 after treatment, the finishing position of the air mattress 20 may have some level of deflation.

It is important to note that the radius of curvature in a person's 14 body flexion (when a person bends forward that person is in flexion)as well as the radius of curvature of a person's 14 body extension (when a person bends backward that person is in extension)should not extend beyond a person's 14 normal physiological positions.

A stretch is felt during inflation of the air mattress 20, when a person's 14 body goes to extension. This stretch should not exceed normal changes in the body length of the person 14. During normal circumstances, a person's 14 body stretch may vary within one inch in 24 hours. The material 18 on the upper surface of the air mattress 20 preferably allows a stretch within 1–2 inches, which is evenly spread along its length.

FIG. 2 through FIG. 9 illustrate progressive stages of inflation and deflation of the air mattress 20 during operation of the therapeutic treatment apparatus 10. These progressive stages are described in further detail as follows.

Figure 2:
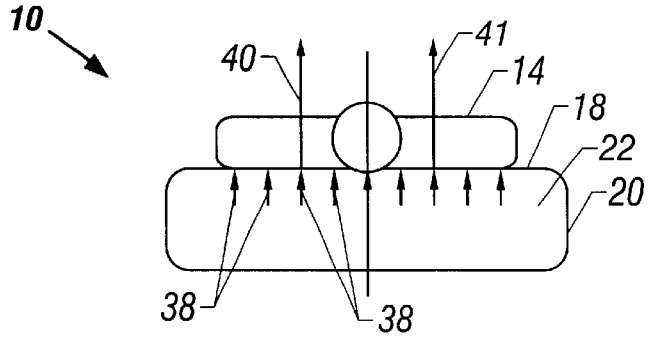
FIG. 2 is an end view of the device of FIG. 1, fully inflated.

As shown in FIG. 1 and FIG. 2, the air mattress 20 is completely inflated, in position "A", with the body of a person 14 positioned face up thereon. Air pressure within the air mattress 20 is directed upwardly as shown by a plurality of air pressure arrows 38, which acts on both the left and right sides of the person's 14 body in near parallel alignment, as shown by directional force arrows 40, 41. Thus, the resultant angle between arrows 40, 41 approaches zero degrees, or near parallel alignment.

Figure 3:
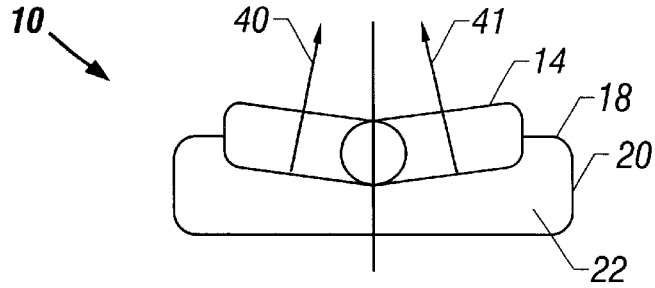
FIG. 3 is an end view of the device of FIG. 1 partially deflated.

In FIG. 3, the air mattress 20 is deflating, in position "B", from the completely inflated position shown in FIG. 2. The angle between directional force arrows 40, 41 is tilting inwardly so that the tips of the directional force arrows 40, 41 move towards each other. This causes the internal body to begin rotating inwardly, which in turn causes extension of the craniosacral system. During the flexion phase, the pressure forces will slightly resist this motion.

Figure 4:
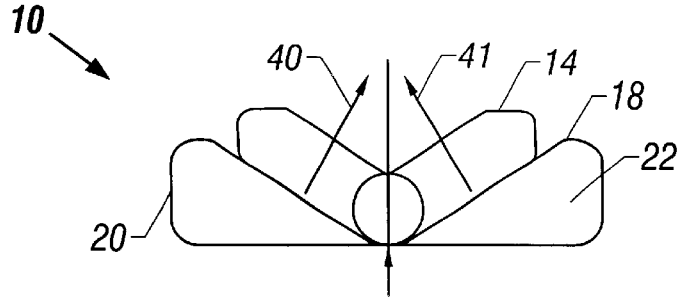
FIG. 4 is an end view of the device of FIG. 1, further deflated into a lowering cradle position.

FIG. 4 shows continued deflation of the air mattress 20, in position "C", as shown in FIG. 3. In this position, the person's 14 body contacts the surface of the special support member 16, which changes the play of forces applied to the person's 14 body. From that point the angle between the directional force arrows 40, 41 starts decreasing. The pressure forces in position "C" leaves alone the internal rotation of the person's 14 body, and guides the external rotation of the body. At position "C" the person may have an illusion that their body is bending backwards. That sensation may bring about an altered state of consciousness.

Figure 5:
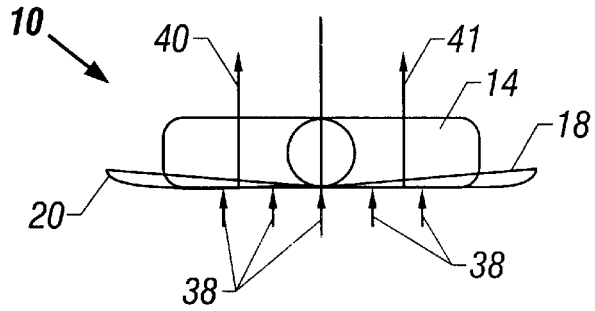
FIG. 5 is an end view of the device of FIG. 1, almost completely deflated into a flattened position.

FIG. 5 shows further deflation of the air mattress 20, into position "D", wherein the air mattress is almost completely deflated, and the body of the person 14 is in a neutral position upon the support structure 12, or positioned on the special support member 16. There is an obvious advantage of placing a person 14 upon the curved, hard surface of the special support member 16 by means of the deflating air mattress 20, as it is accomplished gradually. The timer 30 may be adjusted to provide a dwell time, prior to inflating.

The next stages bring about new sensations which put a person in a deeper relaxed phase.

Figure 6:
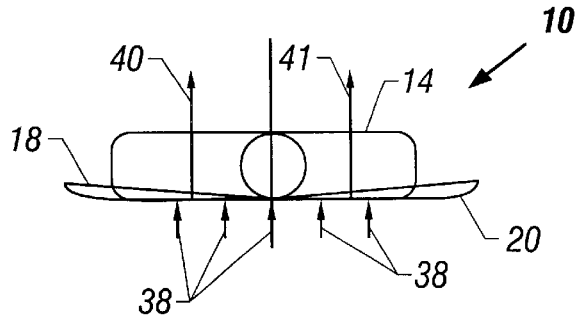
FIG. 6 is an end view of the device of FIG. 1, wherein air is supplied to the air mattress to begin inflation from the almost completely deflated position shown in FIG. 5.

FIG. 6 shows position "E", where the air pump 26 supplies air under pressure through air supply line 24 to air mattress 20. As the air mattress 20 starts inflating, the directional force arrows 40, 41 start increasing, which assists internal rotation and slightly resists external rotation of the person's 14 body. The person 14 senses that their body is moving up and bending forward.

Figure 7:
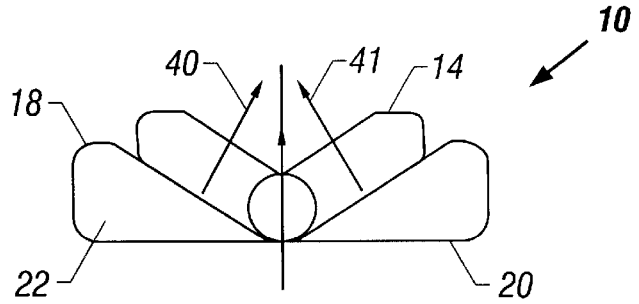
FIG. 7 is an end view of the device of FIG. 1, wherein air continues to be supplied to the air mattress, forming a rising cradle position.

FIG. 7 shows position "F", where the air mattress continues to be inflated by air under pressure from the air pump 26 through supply line 24 to the air mattress 20. The angle between the directional force arrows 40, 41 has reached its maximum value. There is no pressure felt from the special support member 16, or from support structure 12, but there is a force from the air pressure pushing the person upwardly. The movement of the air mattress has started to assist external body rotation (flexion phase of the craniosacral motion), and "guide" internal body rotation (extension phase of the craniosacral motion). The person 14 may have the illusion of being put into a position of bending backwards.

Figure 8:
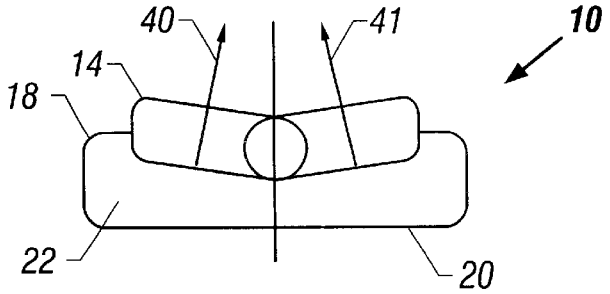
FIG. 8 is an end view of the device of FIG. 1, wherein air continues to be supplied to the air mattress into a rising near inflated position.

FIG. 8 shows position "G", where the air mattress 20 continues inflating. The angle between the two directional force arrows 40, 41 is decreasing, and there is a slight stretch felt along the body. The movement of the air mattress 20 has less influence on the craniosacral motion. The person's 14 body is moving into a neutral position, althought a person 14 may feel that they are bending backward.

Figure 9:
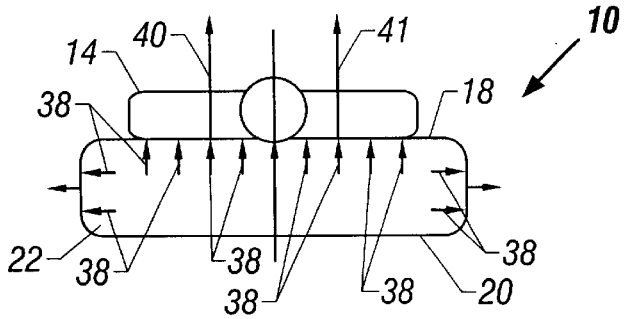
FIG. 9 is an end view of the device of FIG. 1, wherein air continues to be supplied to the air mattress into a fully inflated position.

As shown in FIG. 9, position "H", the air mattress is almost completely inflated. The air pressure arrows 38 within the air mattress 20 provide the firmist support to the person's 14 body, and the material on the upper surface 18 of the air mattress 20 starts stretching evenly in all directions. Since there is more material 18 in length than there is in width, the upper surface of the air mattress 20 provides more movement along its length. This stretch is physically felt by the person 14, producing a pleasant sensation, and bringing about deep relaxation.

The cyclic inflation and deflation acts in a similar way to craniosacral therapy provided by a therapist, who with a slight force of five grams assists and resists craniosacral motion to bring about a positive modification to a person's 14 body.

The sensations which a person may experience being on the therapeutic treatment apparatus 10 disclosed herein, are pleasant and not common. The cyclic movement turns the mind from stressful thoughts and memories. Physical influence of the described movements through reflexes, will activate the parasympathetic system, to bring about deep relaxation. The recorded level of relaxation on a biofeedback device 36 will act as a device to monitor burning calories during physical exercise.

The theraputic treatment apparatus 10 thus described has been described in a preferred embodiment, and may be varied in many ways, and such variations are not to be regarded as a departure from the spirit and scope of this disclosure, nor of the following claims.

PARTS LIST

10—Therapeutic treatment apparatus
12—support structure
14—person
16—special support member
18—material on upper surface of air mattress
20—air mattress
22—internal elements
24—air supply line
26—air pump
28—remote control unit
30—timer
32—switch
36—biofeedback device
38—air pressure arrows
40—directional force arrow
41—directional force arrow

I claim:

1. An inflatable therapeutic treatment apparatus to actively induce parasympathetic responses, which comprises:

a) an air mattress sized to support a patient in a supine position;

b) an air pump operatively connected to the air mattress to controllably inflate and deflate the air mattress to control the changeable geometry of the therapeutic treatment apparatus;

c) a cyclic timing control means operatively connected to the air pump to selectively control the timing of the inflation and deflation cycles of the air mattress;

d) a switch means to selectively actuate the cyclic control timing means; and e) a support member having an overall preselected curvature with a convexly curved upper surface in both longitudinal and transverse cross sections is positioned beneath the air mattress in approximate alignment with a person's spine, and the person's spine is substantially supported upon the support member as the air mattress is cyclically deflated;

wherein a patient resting upon the air mattress is raised and lowered at selected intervals as the air mattress is cyclically inflated and deflated.

2. An inflatable therapeutic treatment apparatus as disclosed in claim 1, wherein the cyclic timing control means includes a null mode which extends for a selected period of time between inflation and deflation cycles.

3. The inflatable therapeutic treatment apparatus as disclosed in claim 1, wherein the air mattress is selectively inflated from three pounds per square inch to twelve pounds per square inch to suit the desired firmness of the air mattress.

4. The inflatable therapeutic treatment apparatus as disclosed in claim 1, wherein the cyclic timing control means is controlled from a remote control means actuated by an operator.

5. The inflatable therapeutic treatment apparatus as disclosed in claim 1, wherein the cyclic timing control means may be pre-programmed by an operator.

6. The inflatable therapeutic treatment apparatus as disclosed in claim 1, wherein the cyclic timing control means controls an amplitude of inflation and deflation, a cyclic speed of inflation and deflation; a number of cycles of inflation and deflation; a starting position, a finishing position, a radius of curvature in the patient's body flexion and extension, and a size of stretch of the air mattress.

7. The inflatable therapeutic treatment apparatus as disclosed in claim 1, wherein each cyclic actuation of the air mattress is more than one minute and less than 10 minutes in duration.

8. The inflatable therapeutic treatment apparatus as disclosed in claim 1, wherein a biofeedback device is attached to the patient to register the level of parasympathetic responses of a person during actuation of the inflatable therapeutic treatment apparatus, and the cyclic timing control means is responsive to the level of parasympathetic responses registered by the biofeedback device.

9. An inflatable therapeutic treatment apparatus to actively induce parasympathetic responses, which comprises:

a) an air mattress sized to support a patient in a supine position;

b) an air pump operatively connected to the air mattress to controllably inflate and deflate the air mattress to control the changeable geometry of the therapeutic treatment apparatus;

c) a cyclic timing control means operatively connected to the air pump to cyclically control the timing of the inflation and deflation of the air mattress, and the cyclic timing control means is pre-programmed by an operator;

d) a null mode responsive to the cyclic timing control means, the null mode actuated for a selected period of time between inflation and deflation cycles;

e) a switch means to selectively actuate the cyclic control timing means; and g) a biofeedback device is attached to the patient to register the level of parasympathetic responses, and the cyclic timing control means is connected to the biofeedback device so that the cyclic timing control means is responsive to the level of parasympathetic responses registered by the biofeedback device;

wherein the patient resting upon the air mattress is systematically raised and lowered at selected intervals as the air mattress is cyclically inflated and deflated, and wherein a null mode is selectively actuated between inflation and deflation cycles when the desired parasympathetic response has been achieved.

10. The inflatable therapeutic treatment apparatus as disclosed in claim 9, wherein the air mattress is selectively inflated from three pounds per square inch to twelve pounds per square inch to suit the desired firmness of the air mattress.

11. The inflatable therapeutic treatment apparatus as disclosed in claim 9, wherein a support member having a pre-selected curvature is positioned beneath the air mattress in approximate alignment with the patient's spine, and the patient's spine is substantially supported upon the support member as the air mattress is deflated.

12. The inflatable therapeutic treatment apparatus as disclosed in claim 9, wherein the cyclic timing control means is actuated from a remote control means actuated by an operator.

13. The inflatable therapeutic treatment apparatus as disclosed in claim 9, wherein the cyclic timing control means controls an amplitude of inflation and deflation, a cyclic speed of inflation and deflation; a number of cycles of inflation and deflation; a starting position, a finishing position, a radius of curvature in the patient's body flexion and extension, and a size of stretch of the air mattress.

14. The inflatable therapeutic treatment apparatus as disclosed in claim 9, wherein each cyclic actuation of the air mattress is more than one minute and less than 10 minutes in duration.

15. An inflatable therapeutic treatment apparatus to actively induce parasympathetic responses, which comprises:

a) an air mattress sized to support a patient in a supine position;

b) an air pump operatively connected to the air mattress to controllably inflate and deflate the air mattress to control the changeable geometry of the therapeutic treatment apparatus;

c) a cyclic timing control means operatively connected to the air pump to cyclically control an amplitude of inflation and deflation, a cyclic speed of inflation and deflation; a number of cycles of inflation and deflation; a starting position, a finishing position, and a radius of curvature in the patient's body flexion and extension, and the cyclic timing control means is pre-programmed by an operator, and wherein the pre-programmed actuation of the timing control means is adapted to be selectively modified by a remote control apparatus;

d) a switch means to selectively actuate the cyclic control timing means:

e) a support member having an overall preselected curvature with a convexly curved upper surface in both longitudinal and transverse cross sections which is positioned beneath the air mattress in approximate alignment with a person's spine, and the person's spine is substantially supported upon the support member as the air mattress is cyclically deflated; and f) a biofeedback device which is attached to the patient to register the level of parasympathetic responses, and the cyclic timing control means is responsive to the level of parasympathetic responses registered bv the biofeedback device;

wherein a patient resting upon the air mattress is systematically raised and lowered at selected intervals as the air mattress is cyclically inflated and deflated.

16. An inflatable therapeutic treatment apparatus of claim 15, wherein the air mattress incorporates a material on an upper surface which is designed to stretch from one to two inches during the inflation cycle.

* * * * *